United States Patent [19]

Mori et al.

[11] Patent Number: 4,539,451

[45] Date of Patent: Sep. 3, 1985

[54] SWITCH

[75] Inventors: Teijiro Mori, Nishinomiya; Yuichi Wada, Kawanishi; Shizutaka Nishisako, Tajimi; Hiroaki Tazawa, Nagoya; Shigeru Masuda, Ichinomiya, all of Japan

[73] Assignee: Mitsubishi Denki Kabushiki Kaisha, Tokyo, Japan

[21] Appl. No.: 550,675

[22] Filed: Nov. 10, 1983

[30] Foreign Application Priority Data

| | | | |
|---|---|---|---|
| Nov. 10, 1982 | [JP] | Japan | 57-197057 |
| Nov. 10, 1982 | [JP] | Japan | 57-197060 |
| Dec. 3, 1982 | [JP] | Japan | 57-212273 |
| Dec. 3, 1982 | [JP] | Japan | 57-212284 |
| Dec. 3, 1982 | [JP] | Japan | 57-212285 |
| Dec. 22, 1982 | [JP] | Japan | 57-225313 |
| Dec. 22, 1982 | [JP] | Japan | 57-225314 |
| Dec. 22, 1982 | [JP] | Japan | 57-194397[U] |
| Feb. 16, 1983 | [JP] | Japan | 58-23977 |

[51] Int. Cl.[3] ..... H01H 33/10

[52] U.S. Cl. ..... 200/147 R; 200/144 R

[58] Field of Search ..... 200/47 R, 144 R

[56] References Cited

U.S. PATENT DOCUMENTS

| | | | |
|---|---|---|---|
| 2,460,118 | 1/1949 | Bennett | 200/147 R |
| 2,524,287 | 10/1950 | Ellis | 200/147 R |
| 2,534,069 | 12/1950 | Schleicher | 200/147 R |
| 2,626,331 | 1/1953 | Basnett | 200/147 R |
| 2,632,827 | 3/1953 | Rypinski | 200/147 R |
| 2,654,815 | 10/1953 | Laverty | 200/147 R |
| 2,898,427 | 8/1959 | Nadeau | 200/147 R |
| 3,564,176 | 2/1971 | Fechant | 200/147 R |

*Primary Examiner*—Robert S. Macon

*Attorney, Agent, or Firm*—Armstrong, Nikaido, Marmelstein & Kubovcik

[57] ABSTRACT

A switch for making and breaking an electric current and having an arc-extinguishing mechanism. Said switch includes a fixed contact plate having a fixed contact thereon, a movable contact plate having a fixed contact adapted for movement to come into and go out of said fixed contact and an arc deflecting plate provided substantially parallel to said movement. Said arc deflecting plate is made of magnetic metal and is formed with a U-shaped portion in proximity to said fixed contact plate.

12 Claims, 30 Drawing Figures

SWITCH

BACKGROUND OF THE INVENTION

The present invention relates to a switch for making and breaking an electric current and more particularly to to an arc-extinguishing mechanism thereof.

The present invention is applicable mainly to electromagnetic contactors and no-fuse breakers.

Referring first to FIG. 1, there is shown an example of a conventional electromagnetic contactor, having a symmetrical structure. In FIG. 1, the numeral 1 denotes a mounting base molded of a plastic material; the numeral 2 denotes a fixed iron core which comprises laminated silicon steel plates on the mounting base 1; the numeral 3 denotes a movable iron core which also comprises a lamination of silicon steel plates and is disposed in an opposed relation to the fixed iron core 2; the numeral 4 denotes an operating coil which provides a driving force for attracting the movable iron core 3 toward the fixed iron core 2 against a tripping spring (not shown); the numeral 5 denotes a cross bar formed of a plastic material, the cross bar 5 having a square window and holding the movable iron core 3 at its lower end. The numeral 6 denotes a movable contact plate inserted through the square window of the cross bar 5 and held in place by a pressure spring 7; the numeral 6A denotes a movable contact affixed to the movable contact plate 6; the numeral 8 denotes a fixed contact plate for making an electric circuit, the fixed contact plate 8 being disposed in an opposed relation to the movable contact plate 6; the numeral 8A denotes a fixed contact affixed to the fixed contact plate 8; and the numeral 8C denotes a terminal portion of the fixed contact plate 8.

Further, the numeral 9 denotes a terminal screw for connecting the electromagnetic contactor body to an external circuit; the numeral 10 denotes a base for mounting the fixed contact plate 8; and the numeral 11 denotes a cover which covers the upper portions of the electromagnetic contact plates. Inside the cover 11 is disposed a metallic arc deflecting plate 13 formed of a magnetic material for deflecting an arc 12 which is produced between the fixed contact 8A and movable contact 6A. FIG. 2 shows a mounting mode of the metallic arc deflecting plate 13 relative to the fixed contact plate 8 and fixed contact 8A. The metallic arc deflecting plate 13 is constituted as a channelshaped plate erected so as to surround the fixed contact 8A, and it is provided with a notched end 14 in a position close to the fixed contact plate 8 for insertion therethrough of the latter.

In this conventional electromagnetic contactor having the above-described construction, the movable iron core 3 moves away from the fixed iron core 2 by virtue of a tripping spring (not shown) when the operating coil 4 is deenergized. Since the cross bar 5 assumes the state shown in FIG. 1, at this time, the fixed and movable contacts 8A and 6A open producing the arc 12 between the fixed contact 8A and movable contact 6A. But the arc 12 is deflected by the metallic arc deflecting plate 13 and extinguished at the zero point of electric current, so that the electric current is cut off.

The extinguishing process for the arc 12 in such conventional electromagnetic contactor will now be described more in detail with reference to FIG. 3 which shows a section of an arc deflecting chamber. The arc 12 formed between the movable contact 6A and the fixed contact 8A is attracted by the metallic arc deflecting plate 13 of a magnetic material and stretched like an arc 12A. The resultant increase in arc voltage causes insulation breakdown between the fixed contact plate 8 and the metallic arc deflecting plate 13 and also between the notched end 14 of the metallic arc deflecting plate 13 and the movable contact 6A. As a result, the arc 12A is divided into two arcs 12B and 12C, which arcs are extinguished at the zero point of electric current. In the conventional electromagnetic contactor wherein the arc is extinguished according to such process, the stretch of arc is restricted by the presence of the metallic arc deflecting plate 13, and the arc voltage is low. As a result insulation breakdown is difficult to take place between the fixed contact plate 8 and the metallic arc deflecting plate 13 and also between the metallic arc deflecting plate 13 and the movable contact 6A. In other words, the arc 12 is difficult to be divided into two arcs 12B and 12C. Moreover, once the arc 12 is divided into two, the arc 12 tends to stay due to a field concentration at the end portion 14 which is inferior in thermal conductivity. Thus, not only remarkable breaking performance cannot be attained, but it creates a major factor of degradation of the arc deflecting plate.

SUMMARY OF THE INVENTION

Therefore, it is an object of the present invention to provide a switch which shows an improved performance. Said switch comprises fixed contact means; movable contact means adapted for movement to come into contact with said fixed contact means and to go out of contact with the same such that a first gap is defined therebetween; and an arc deflecting plate of magnetic metal provided generally in parallel with said movement, said arc deflecting plate being formed with a U-shaped bent portion in proximity to said fixed contact means, said fixed contact means including a fixed contact plate and a fixed contact affixed to said fixed contact plate at an end portion thereof, said fixed contact plate extending in a direction generally perpendicular to said arc deflecting plate to define a second gap therebetween.

DETAILED DESCRIPTION OF THE EMBODIMENTS

Figure 4:
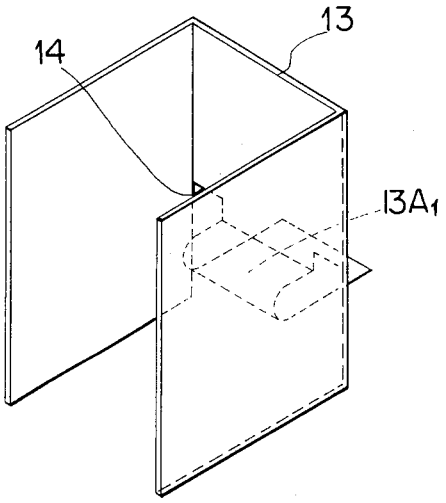
FIG. 4 is a diagram in perspective showing an arc deflecting plate in one embodiment of the present invention.
Figure 5:
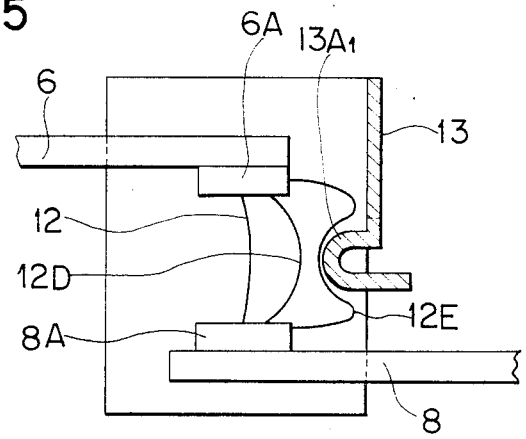
FIGS. 5 and 6 are illustrations showing arc-extinguishing processes being performed in the embodiment of FIG. 4.
Figure 6:
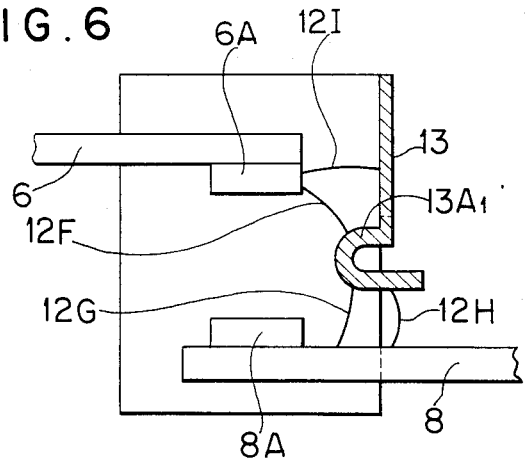

The present invention will now be described with reference to embodiments thereof which are illustrated in FIGS. 4 through 7. The switch according to these embodiments include a fixed contact 8A; a movable contact 6A adapted for movement to come into contact with said fixed contact 8A and to go out of contact with the same such that a first gap is defined therebetween; an arc deflecting plate 13 of magnetic metal provided generally in parallel with said movement. Said fixed contact 8A is affixed to said fixed contact plate 8 at an end portion thereof and said fixed contact plate 8 extends in a direction generally perpendicular to said arc deflecting plate 13 to define a second gap therebetween. Except for a metallic arc deflecting plate, the switches of these embodiments are similar to the foregoing prior art construction. Therefore, only a metallic arc deflecting plate 13 is shown in a perspective view in FIG. 4. As shown in FIG. 4, the arc deflecting plate of the invention differs from that of prior in that this metallic arc deflecting plate 13 is provided with a U-shaped portion 13A, having a bent tongue-like extension at its notched end 14 in proximity to the fixed contact plate 8 and said U-shaped portion 13A, is positioned to project toward said first gap. FIGS. 5 and 6 are longitudinally sectional views of an arc deflecting chamber using this metallic arc deflecting plate 13. With reference to these figures, the process from the formation of the arc 13 between the fixed and movable contacts 8A and 6A or across the first gap up to its extinction will now be described. The arc 12 formed between the fixed and movable contacts 8A and 6A is attracted by the metallic arc deflecting plate 13 of a magnetic material. As a result it is stretched curvedly along the U-shaped portion 13A, of the metallic arc deflecting plate 13 like an arc 12E after assuming the state of an arc 12D, thus increasing the arc voltage. Subsequently, insulation breakdown occurs between the movable contact 6A and the U-shaped portion 13A, of the metallic arc deflecting plate 13 and also between the U-shaped portion 13A, of the arc deflecting plate 13 and the fixed contact plate 8 such that the arc is divided into two arcs 12F and 12G as shown in FIG. 6. As a result, an electric current flows through the U-shaped portion 13A, of the metallic arc deflecting plate 13, so that the divided arcs 12F and 12G are more driven outwards in the form of arcs 12H and 12I shown in FIG. 6 by a magnetic field built up by the electric current flowing through the U-shaped portion 13A, of the metallic arc deflecting plate 13, and are extinguished at the zero point of the current. Thus, the current is cut off.

Figure 1:
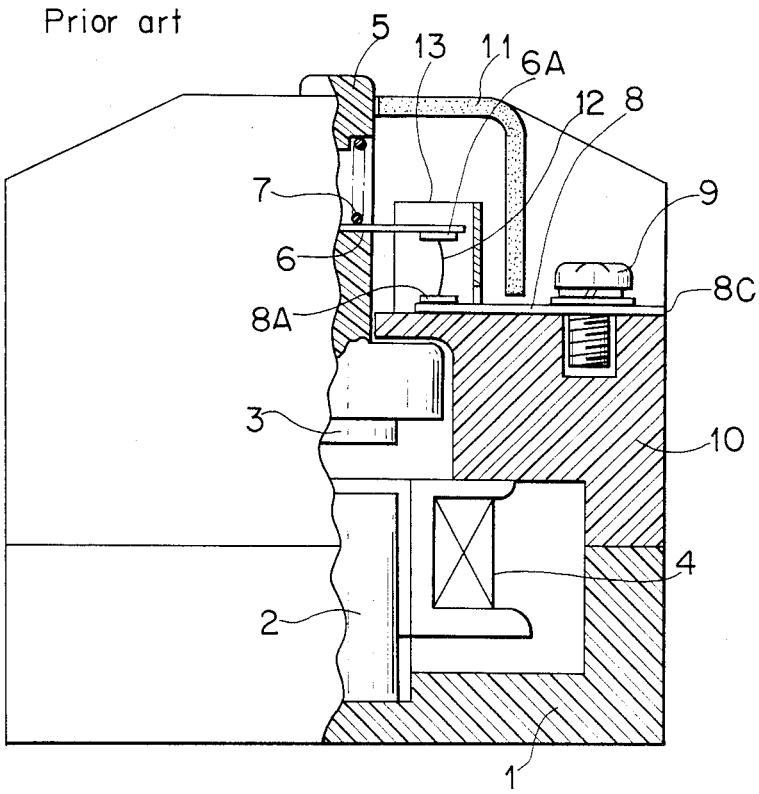
FIG. 1 is a partially cross-sectional view of a conventional switch being employed in an electromagnetic contactor.
Figure 2:
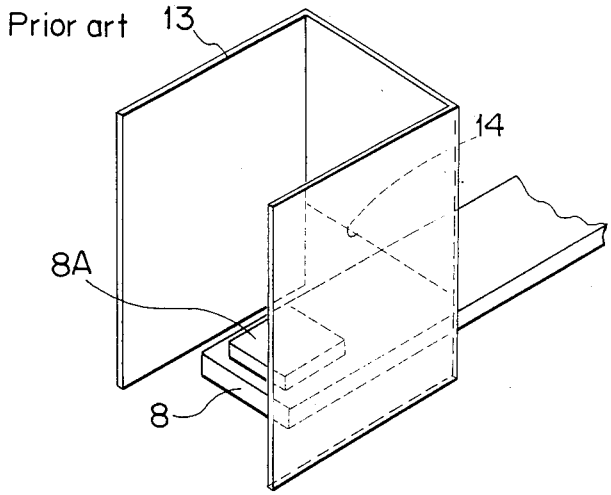
FIG. 2 is a perspective diagram of an arc deflecting chamber of the electromagnetic contactor of FIG. 1, the essential part thereof being enlarged in the view.
Figure 3:
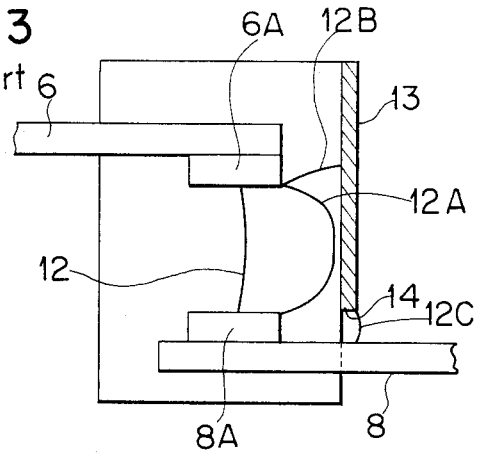
FIG. 3 Prior art
FIG. 3 an illustration showing an arc extinguished process which is performed in the conventional electromagnetic contactor.

In the electromagnetic contactor to which the present invention was applied, since the extinction of arc is effected in the above-described manner, the arc 12 is easily divided at the U-shaped portion 13A, of the metallic arc deflecting plate 13 and then driven at a high speed on the metallic arc deflecting plate 13 by a magnetic field built up by the electric current flowing in the U-shaped portion 13A, of the arc deflecting plate 13, so it is possible to extinguish the arc rapidly. Moreover, since unlike the conventional contactor shown in FIG. 3 a field concentration does not occur at the metallic arc deflecting plate 13 nor is formed an arc at the fore end portion which is inferior in thermal conductivity, an extremely superior breaking performance can be attained.

Figure 7:
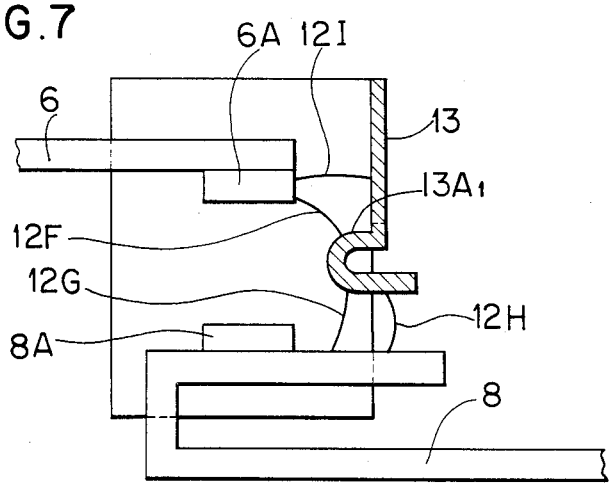
FIG. 7 shows another embodiment of the invention and the arc-extinguishing process performed therein.

It goes without saying that the present invention can afford the same effect also in the case of another embodiment using such a different shape of a fixed contact plate 8 as shown in FIG. 7.

Figure 8:
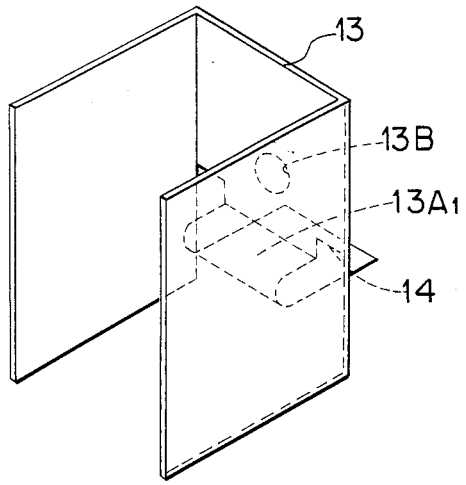
FIG. 8 is a diagram in perspective showing an arc deflecting plate of a further embodiment of the invention.
Figure 9:
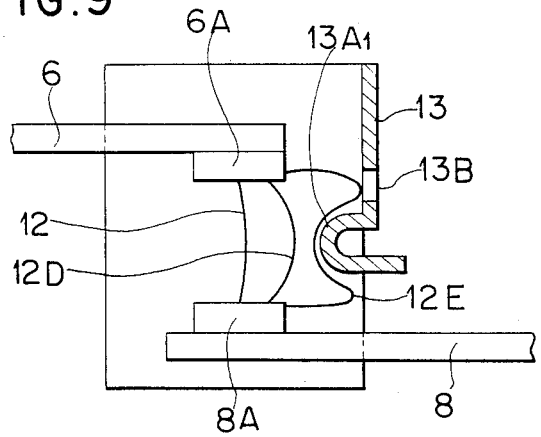
FIGS. 9 and 10 are illustrations showing arc-extinguishing processes being performed in the embodiment of FIG. 8.
Figure 10:
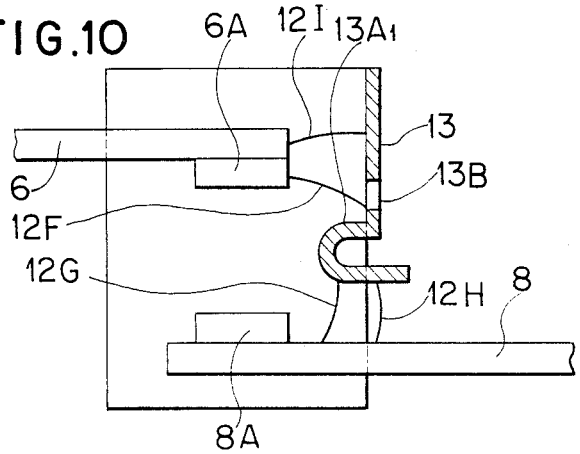

A further embodiment of the invention will be described referring to FIGS. 8 to 11. As shown in FIG. 8, this metallic arc deflecting plate 13 is provided with a U-shaped portion 13A, having a bent tongue-like extension at its notched end 14 which is provided in proximity to the fixed contact plate 8. Although the above-mentioned structure is substantially the same as the above-mentioned embodiments, there are additionally provided a gas-flow hole 13B in the arc deflecting plate 13 near the portion 13A. In this respect, this metallic arc deflecting plate 13 is different from the foregoing embodiment. FIGS. 9 and 10 are longitudinally sectional views of an arc deflecting chamber using this metallic arc deflecting plate 13. With reference to these figures, the process from the production of the arc 12 between the fixed and movable contacts 8A and 6A up to the extinction thereof will now be described. The arc 12 produced between the fixed and movable contacts 8A and 6A is attracted by the metallic arc deflecting palte 13 of a magnetic material, so that it is stretched along the U-shaped portion 13A, of the metallic arc deflecting plate 13 in the form of an arc 12E after assuming the state of an arc 12D. At this time, the arc voltage is raised and at the same time an arced gas which contains electrons and ionized anions passes through the gas-flow hole 13B, such that insulation breakdown occurs in the vicinity of the hole 13B, and immediately thereafter the arc 12E is divided into two arcs 12F and 12G. As a result, an electric current flows through the U-shaped portion 13A, of the metallic arc deflecting plate 13, such that the divided arcs 12F and 12G are driven outwards in the form of arcs 12H and 12I shown in FIG. 10 by a magnetic field built up by the electric current flowing through the U-shaped portion 13A, of the metallic arc deflecting plate 13, and arc extinguished at the zero point of the current. Thus, the current is cut off.

Since extinction of arc is effected in the above-described manner, the arc 12 in the electromagnetic contactor to which the present invention was applied causes insulation beakdown in the vicinity of the hole 13B which is formed in the arc deflecting plate 13 above the U-shaped portion thereof and just thereafter the arc is divided in two and then driven at a high speed on the metallic arc deflecting plate 13 by a magnetic field built up by the electric current flowing in the U-shaped portion of the arc deflecting plate 13. In this way, it is possible to extinguish the arc rapidly. Moreover, since a field concentration does not occur at the metallic arc deflecting plate 13 nor is produced an arc at the fore end portion which is inferior in thermal conductivity unlike the conventional contactor shown in FIG. 3, an extremely superior breaking performance can be attained. Particularly, the presence of the gas-flow hole 13B is advantageous in that insulation breakdown takes place easily in the vicinity of the hole 13B and the arcing time is thereby shortened.

Figure 11:
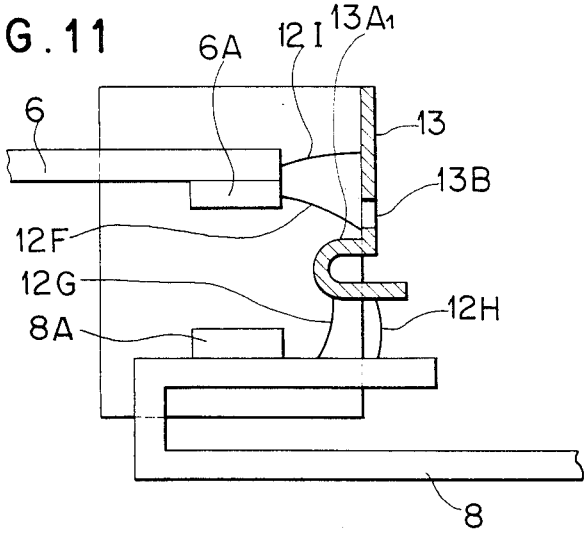
FIG. 11 is a still further embodiment of the invention and the arc-extinguishing process performed therein.

It goes without saying that the present invention can afford the same effect also in the case of such a different shape of a fixed contact plate 8 as shown in FIG. 11.

Figure 12:
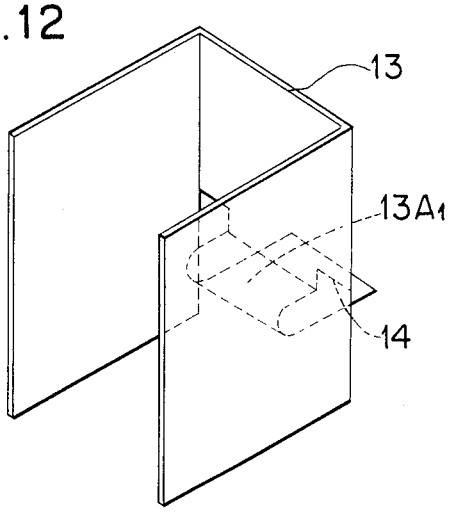
FIG. 12 is a diagram in prespective of a still further embodiment of the invention.
Figure 13:
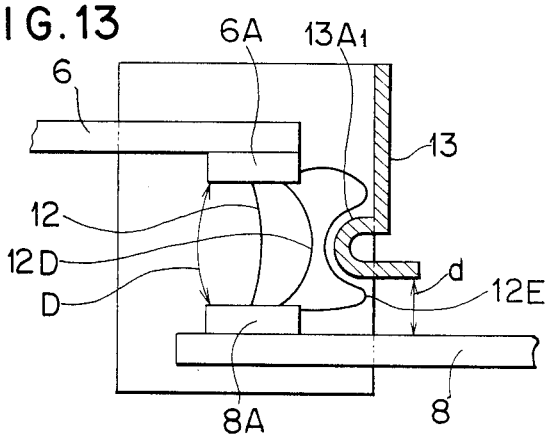
FIG. 13 is a side view of the embodiment of FIG. 12 showing the arc-extinguishing process performed therein.

A still further embodiment of the invention will be described with reference to FIGS. 12 to 13. Said embodiment has substantially the same structure as the first embodiment as seen in FIG. 12; this metallic arc deflecting plate 13 is provided with a U-shaped portion 13A, having a bent tongue-like extension at its notched end 14 which is provided in proximity to the fixed contact plate 8. Said U-shaped portion 13A, is oriented to project toward the first gap. The spacing d or the second gap between the U-shaped portion 13A, and the fixed contact plate 8 is set at approximately half the spacing D of said U-shaped portion 13A, is positioned midway in the first gap between the movable contact 6A and the fixed contact 8A when the former takes the opened position. This switch is suitable for use as a lowvoltage switch for applied voltage below 660 V, and in this case d is set at 1 to 3 mm for 2 to 6 mm of D.

Since the spacing d between the U-shaped portion 13A, and the fixed contact plate 8 is set at approximately half the spacing D , a sufficient increase of the arc voltage is attainable and the arcing time is shortened by the rapid movement of the arc.

The spacing d is set at approximately half the spacing D because it has been confirmed that a narrower spacing d will not raise the arc voltage whereas a wider spacing d makes it difficult for the arc between the contacts to move toward the metallic arc deflecting plate 13.

A still further embodiment will be described with reference to FIGS. 14, 15A, and 15B. An arc deflecting plate 13 includes a channel-shaped plate having a main portion 13A and wing portions 13C extending from respective sides thereof such that said channel-shaped plate surrounds the fixed contact 6A and the movable contact 8A. A fixed contact plate 8 extends in a direction perpendicular to said main portion 13A.

Figure 14:
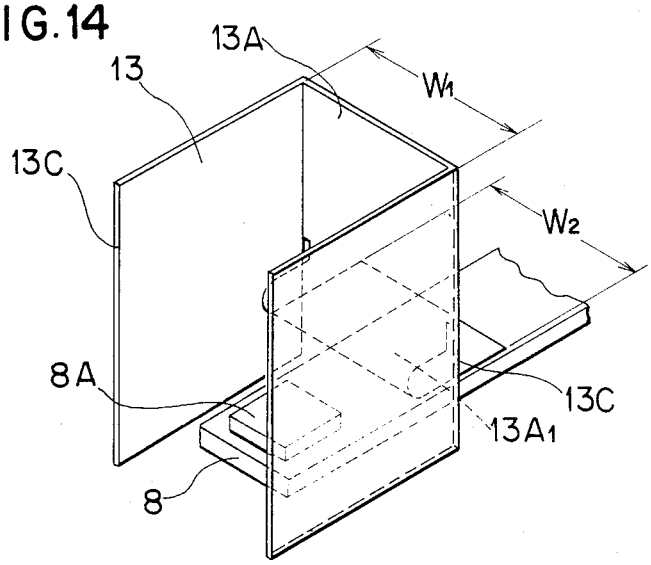
FIG. 14 is a diagram in perspective of an arc deflecting plate of a still further embodiment of the invention.
Figure 15A:
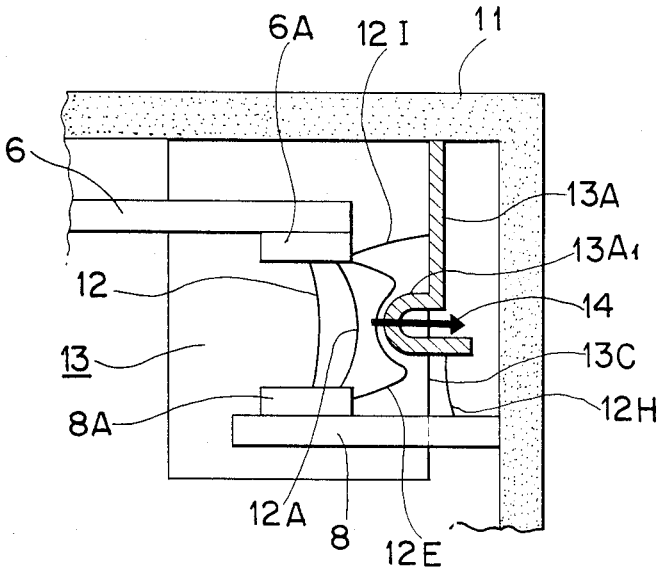
FIGS. 15A and 15B are illustrations showing the arced gas flowout taking place in the embodiment of FIG. 14.
Figure 15B:
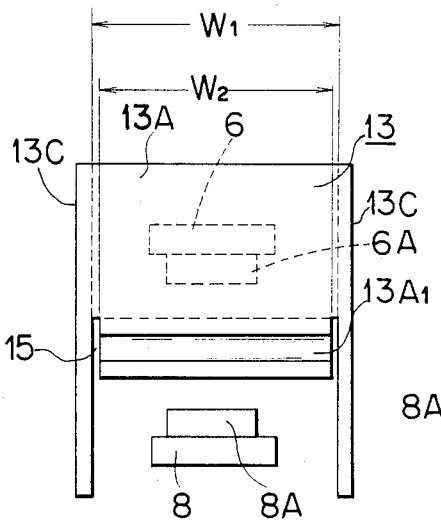

As shown in FIG. 14, the main portion 13A of the metallic arc deflecting plate 13 is provided with a U-shaped portion $13A_1$ having a bent tongue-like extension in a position close to the fixed contact plate 8. The width W2 of the projection 13A is almost equal to the width W2 between both sides 13C of the metallic arc deflecting plate 13, and the gaps between the end portions of the U-shaped portions $13A_1$ and the sides 13C of the arc-extinguishing plate 13 are extremely small. In this respect, this metallic arc deflecting plate 13 is different from the foregoing embodiments. An arc deflecting chamber using this metallic arc deflecting plate 13 is shown in FIG. 15A. With reference to this figure, the process from the production of the arc 12 between the fixed and movable contacts 8A and 6A up to its extinction will now be described. The arc 12 produced between the fixed and movable contacts 8A and 6A is attracted by the metallic arc deflecting plate 13 of a magnetic material such that it is stretched along the U-shaped portion 13A, as an arc 12E after assuming the state of the an arc 12A. At this time, the arc voltage is raised whereas an arced gas 14 which contains electrons and ionized anions blows out from gaps 15 defined by the sides 13C of the arc deflecting plate 13 and the end portions of the U-shaped portion, $13A_1$ as seen in FIG. 15B. Since the gaps 15 are small, however, the amount of the arced gas 14 is limited so much that the gas can be prevented from blowing out in a concentrated manner in the vicinity of the surface of the cover 11. Immediately thereafter, the arc 12B is divided into two arcs. As a result, an electric current flows through the U-shaped portion $13A_1$ of the metallic arc deflecting plate 13 such that said divided two arcs are driven outwards in the form of arcs 12H and 12I shown in FIG. 15A by a magnetic field built up by the electric current flowing through the U-shaped portion $13A_1$ of the metallic arc deflecting plate 13, and then are extinguished at the zero point of the current. Thus, the current is cut off.

Since the extinction of arc is effected in the abovdescribed manner, even during an inching operation repeating on off actions of a motor, the arced gas 14 by the arc 12 produced between the contacts can be prevented from blowing out in a concentrated manner in the vicinity of the surface of the cover 11. Consequently, an external interphase short-circuiting caused by a thermal deterioration of the cover 11 can be prevented and at the same time the inching life of the motor can be improved.

Figure 16:
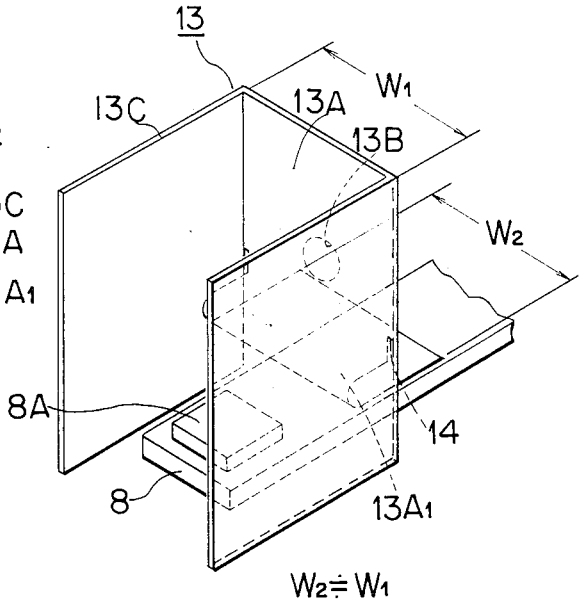
FIG. 16 is a diagram in perspective of the arc deflecting plate of a still further embodiment of the invention.
Figure 17A:
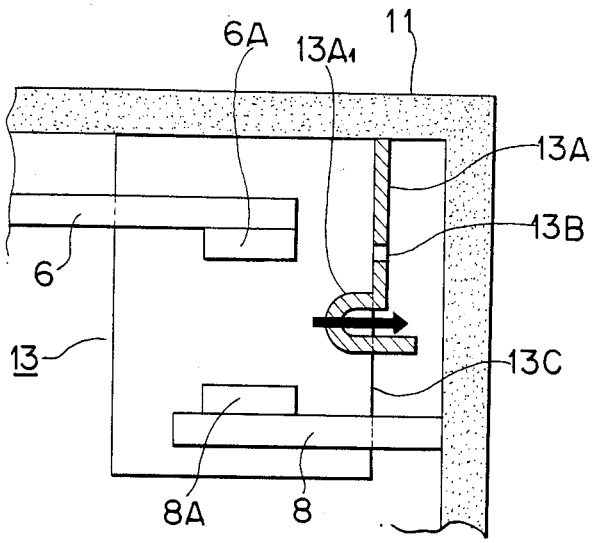
FIGS. 17A and 17B are illustrations showing the arced gas flowout taking palce in the embodiment of FIG. 16.
Figure 17B:
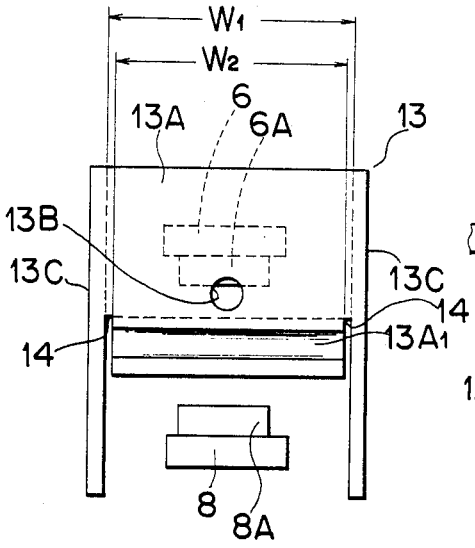
Figure 18:
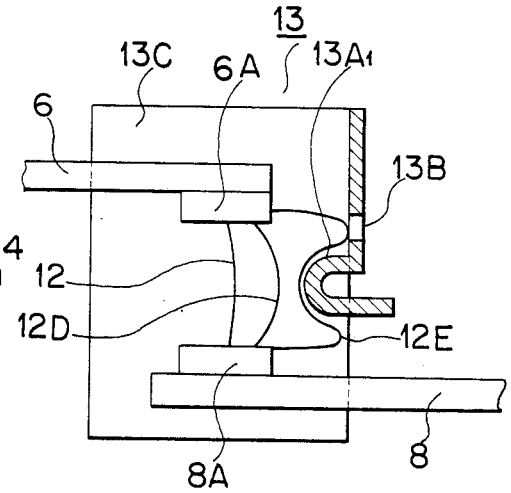
FIG. 18 and FIG. 19 are illustrations showing arc-extinguishing processes in the above embodiment.
Figure 19:
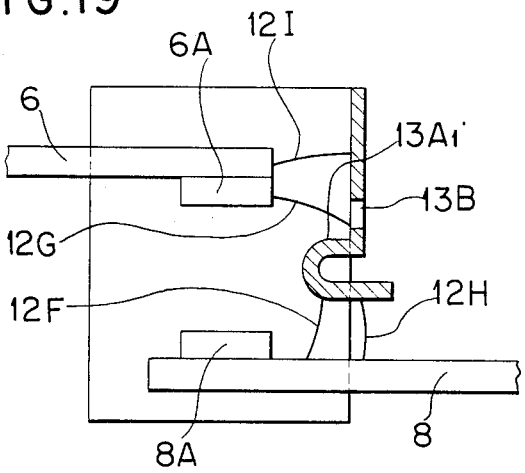

As shown in FIG. 16, the metallic arc deflecting plate 13 is provided with a U-shaped portion $13A_1$ having a bent tongue-like extension at its notched end 14 which is provided in proximity to the fixed contact plate 8. Besides, the width W2 of the U-shaped portion $13A_1$ is almost equal to the width W1 of main portion 13A of the metallic arc deflecting plate 13 which a gas-flow hole 13B is provided above the U-shaped portion $13A_1$. In this respect, this metallic arc deflecting plate 13 is different from the foregoing embodiments. An arc deflecting chamber using this metallic arc deflecting plate 13 is shown in FIG. 17A and 17B. With reference to these figures, the process from the production of the arc 12 between the fixed and movable contacts 8A and 6A up to the extinction thereof will now be described on the basis of FIGS. 18 and 19. The arc 12 produced between the fixed and movable contacts 8A and 6A is attracted by the metallic arc deflecting plate 13 of a magnetic material such that it is stretched along the U-shaped portion $13A_1$ like an arc 12E after assuming the state of an arc 12D. At this time, the arc voltage is raised while an arced gas which contains electrons and ionized anions passes through the gas-flow hole 13B such that there occurs insulation breakdown in the vicinity of the hole 13B, and immediately thereafter the arc 12E is divided into two arcs 12F and 12G. As a result, an electic current flows through the U-shaped portion $13A_1$ of the metallic arc deflecting plate 13 such that the divided arcs 12F and 12G are driven outwards in the form of arcs 12H and 12I shown in FIG. 9 by virtue of a magnetic field built up by the electric current flowing through the U-shaped portion $13A_1$ of the metallic arc deflecting plate, and are extinguished at the zero point of the current. Thus, the current is cut off.

The extinction of the arc is effected in the above-described manner. In other words, in the electromagnetic contactor to which the present invention was applied, as described above, the arc 12 causes insulation breakdown in the vicinity of the hole 13B which is formed above the U-shaped portion $13A_1$ of the metallic arc deflecting plate 13.

Just thereafter the arc is divided in two and then driven at a high speed on the metallic arc deflecting plate 13 by virtue of a magnetic field built up by the electric current flowing through the U-shaped portion $13A_1$ thus extinguishing the arc rapidly.

Besides, the presence of the hole 13B for flow of the arced gas permits an easy occurrence of insulation breakdown in the vicinity of the hole 13B, shortening the arcing time. Further, since the U-shaped portion $13A_1$ is formed such that its width W2 is substantially equal to the width W1 of the main portion 13A of the metallic arc deflecting plate 13, the gaps between the U-shaped portion $13A_1$ and both sides 13C of the metallic arc deflecting plate 13 is negligible, whereby the, efflux phenomenon of the high-temperature arced gas from the gaps is suppressed to a large extent and consequently an external interphase short-circuiting caused by a thermal deterioration of the cover 11 is prevented. This means an improvement of the motor inching life.

Figure 20:
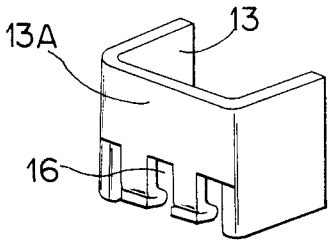
FIG. 20 is a perspective view of the arc deflecting plate of a still further embodiment of the invention.
Figure 22:
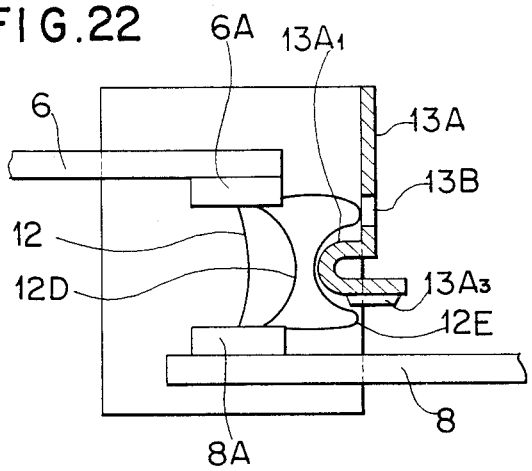
FIGS. 22 and 23 are illustration showing arc-extinguishing processes taking place in the switch according to the above embodiment.
Figure 23:
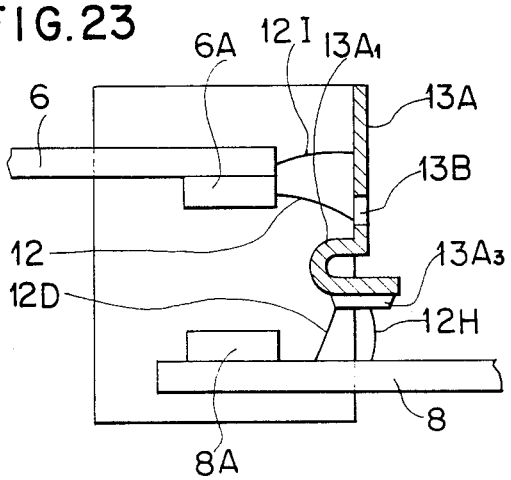

A still further embodiment of the invention will be described with reference to FIG. 20.

In this embodiment, a notch 16 is formed in the main portion 13A of the arc deflecting plate 13. Said notch 16 is in the form of a slit formed positioned centrally of the main portion 13A and opening in facing relation to the fixed contact 8A.

It has experientially been confirmed that an arc produced between the contacts is attracted to the notch 16 in the arc deflecting plate 13.

According to this embodiment, therefore, the arc produced at the time of opening of the contacts is attracted to the notch 16, effecting the rapid commutation of the arc to the arc deflecting plate, whereby the arc can be extinguished in an instant. Consequently, it become possible to improve the arc cut-off performance of the device. For example, while the cut-off capability of the conventional device is of the order of only 500 V, it has confirmed that the device of this embodiment can afford a cut-off capability of the order of 600 V.

In the device of this embodiment, moreover, since the notch 16 is formed in a central position with respect to both side wall ends of the main portion 13A, the arc is converged to the central part of the main portion 13A. Consequently, the greater part of the arced gas is discharged from the notch 16, whereby the energy of the arced gas which passes between the base 10 and the side end of the arc box 11 is weakened, whereby the wear and damage of the base 11 and the side end portion of the arc box can be reduced.

Figure 21:
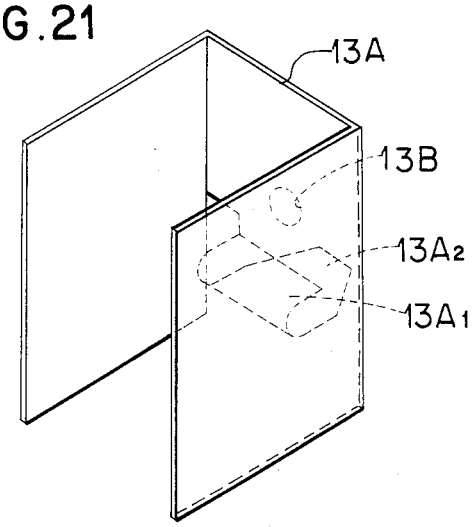
FIG. 21 is a diagram in perspective of the arc deflecting plate of a still further embodiment of the invention.

Next, a still further embodiment of the invention will be described with reference to FIG. 21. The general structure of said embodiment is substantially the same as that of the first embodiment. However, the arc deflecting plate 13 has a U-shaped portion $13A_1$ which has a tapering free end tongue $13A_2$. By adoption of such a tapered shape, it becomes possible to drive the arc toward the central area of the structure away from the base and the side ends of the arc box, which are prevented from being damaged by the arc.

Further, in this embodiment, an auxiliary arc-extinguishing projection $13A_3$ is formed on the lower surface of the tongue portion of the arc deflecting plate 13, whereby the arc-extinguishing discharge between the arc-deflecting plate 13 and the fixed contact plate 8 can be done more easily.

Moreover, the auxiliary arc-extinguishing projection $13A_3$, exhibits an auxiliary effect against the discharge wear, making the life of the arc deflecting plate 13 longer.

Moreover, a gas-flow hole 13B is formed in a position above the U-shaped portion $13A_1$, whereby the arc commutating time mentioned above can be further shortened. More particularly, an arcked gas which contains electrons and ionized anions passes through the gas-flow hole 13B upon formation of an arc, such that insulation breakdown is apt to occur in the vicinity of the gas-flow hole 13B. As a result, it becomes possible to effect insulation breakdown between the movable contact 6A and the arc deflecting plate 13, namely, the extremely quick commutation of the arc.

Further, since the arced gas blows out in a concentrated manner from the gas-flow hole 13B, the gas evolution phenomenon from the side of the arc box 11 can be eliminated. As a result, the side of the arc box 11, and that of the base 10 can be prevented from being eroded by the gas as experienced in the conventional device.

Figure 24:
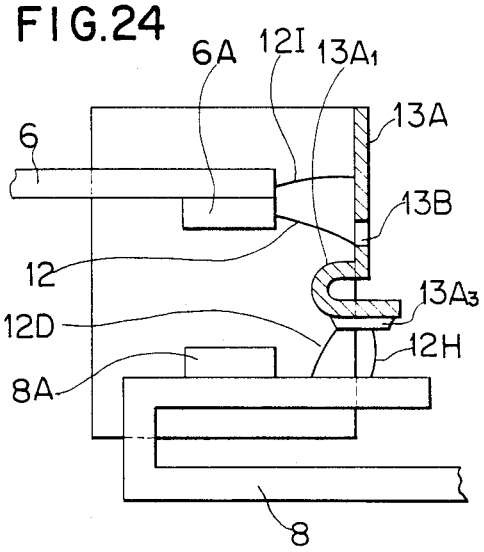
FIG. 24 is a side view of a still further embodiment of the invention.

A still further embodiment of the invention will be described with reference to FIG. 24.

This embodiment is different from the foregoing embodiment in that the fore end portion of the fixed contact plate 8 is bent in a channel-shaped form and the commutation of arc between the arc deflecting palte 13 and the fixed contact plate 8 is effected by the lower side of the U-shaped portion 13 and the fore end face of the fixed contact plate 8.

The commutation behavior of the arc from the movable contact 6A to the arc deflecting plate 13 in this embodiment is the same as in the previous embodiment. Therefore, also in this embodiment, like the previous embodiment, the arc produced between the contacts can be commutated to the arc deflecting plate 13 and extinguished rapidly.

Figure 25:
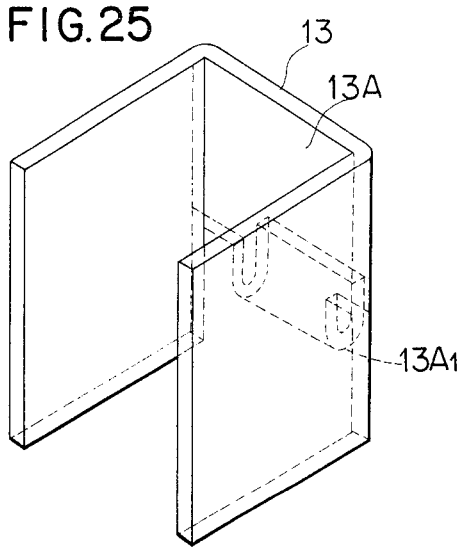
FIG. 25 is a diagram in perspective of the arc-deflecting plate of a still further embodiment of the invention.
Figure 27:
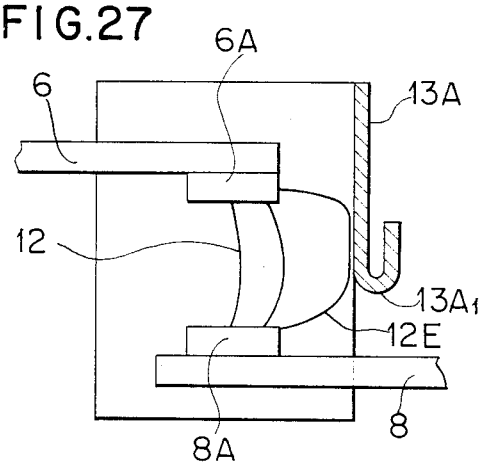
FIGS. 27 and 28 are illustrations showing arc-extinguishing processes taking place in the switch according to the above embodiment.
Figure 28:
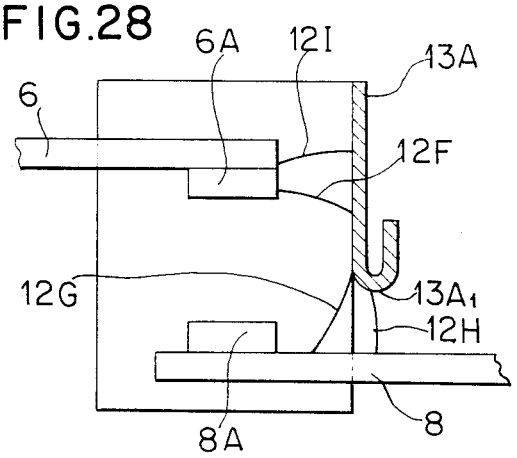

A still further embodiment of the invention will be described with reference to FIG. 25. In this embodiment, a main portion 13A of the arc deflecting plate 13 is bent outwards to form a U-shaped portion 13A, opposing the second gap which the arc deflecting plate 13 and the fixed contact plate 8 generally defines. In other words, the projecting end of the U-shaped portion 13A, is opposed to the fixed contact plate 8 across the gap therebetween or projects toward the second gap.

In this embodiment, the shape of the U-shaped portion 13A is determined on the basis of results of a preliminary experiment conducted for determining the breaking capability for the arc which has been commutated from the movable contact 6A to the arc defelcting plate 13.

Figure 26:
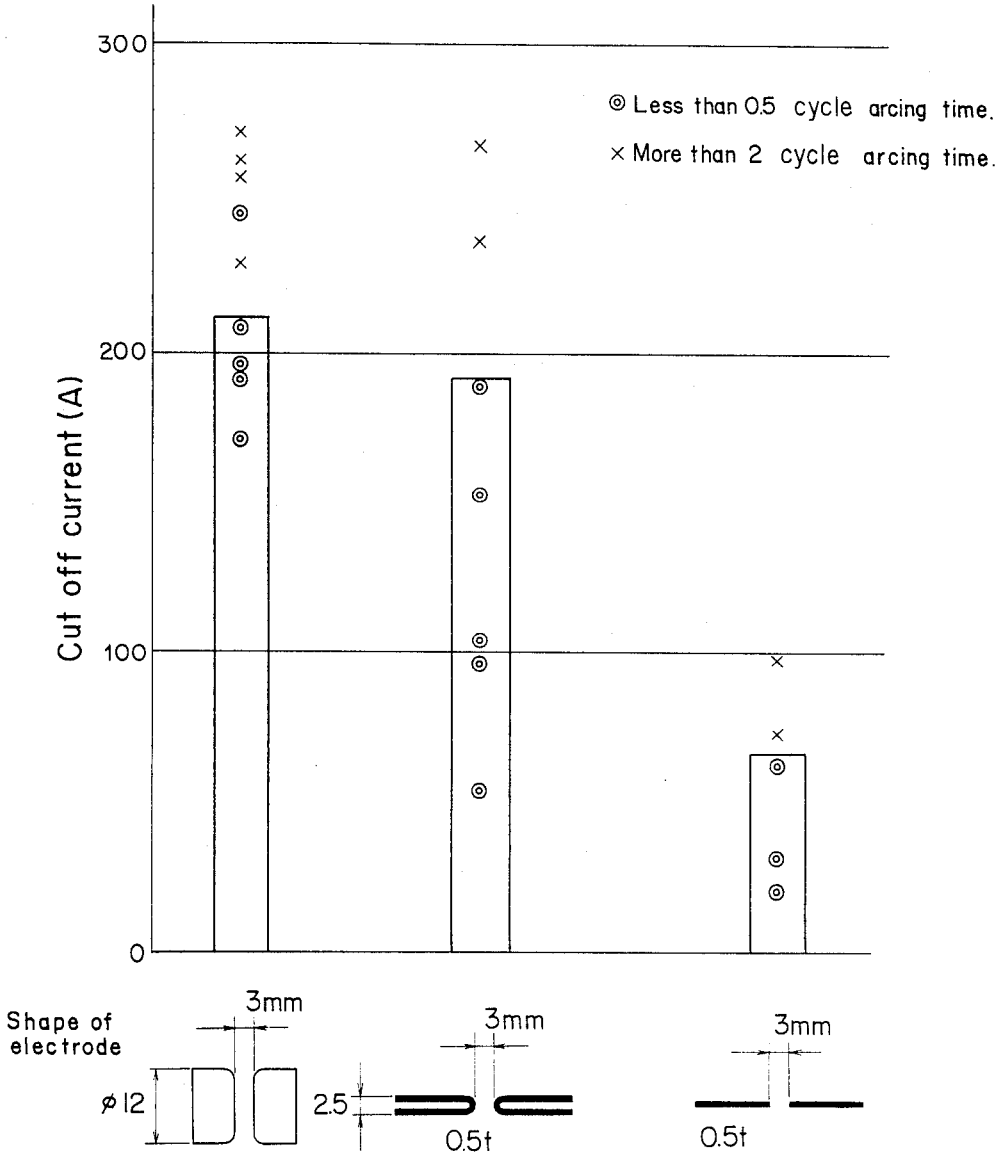
FIG. 26 is a graph showing the relationship between the electrode configuration and the cut off current obtained as a result of tests conducted to design the shape of the arc deflecting plate.

More particularly, in FIG. 26 there are shown results of the experiment conducted using various shapes of electrodes and breaking currents corresponding to the shapes of the electrodes. In this experiment, a fuse was connected between electrodes of different shapes and a breaking current was let flow in the electrodes to open the fuse. Then the time required from the production of an arc between both electrodes upon failure of the fuse until completion of breaking was measured and the maximum breaking current in the case of the arc-extinguishing time being not longer than 0.5 cycle was determined.

From the experimental results it can be seen that in the case where the electrodes have sharp ends like a needle, the current value capable of being interrupted is small, while when the electrodes have curved ends, the current breaking capability is enhanced. This current breaking capability is correlated with the arc-extinguishing capability. Consequently, the arc-extinguishing capability can be enhanced by forming the arc-extinguishing portion of the arc deflecting plate in a curved shape, whereby the arc which has been commutated to the arc deflecting plate 13 can be extinguished rapidly.

In this embodiment, the arc-extinguishing portion of the arc deflecting plate is formed in U-shaped on the basis of the foregoing experimental results.

The fixed contact plate 8 is formed in the shape of a flat plate, and the U-shaped portion 13$A_1$ of the arc deflecting plate 13, which is opposed to and spaced by a predetermined distance from the fixed contact plate 8, is formed as a U-shaped curved portion. Therefore, as will be appreciated from the foregoing experimental results, the arc-extinguishing capabitily is enhanced, whereby a rapid extinction of arc from the U-shaped portion 13 to the fixed contact plate 8 is attained.

Further, there scarcely occurs the phenomenon of wear and damage of the U-shaped portion 13 at the time of an arc-extinguishing discharge from U-shaped portion 13 to the fixed contact plate 8, thus making the service life of the arc deflecting plate 13 longer.

According to this embodiment, the arc which has been produced at the time of opening of the contacts and commutated to the arc deflecting plate can be extinguished rapidly from the arc deflecting plate to the fixed contact plate.

Further, the grid scarcely undergoes wear or damage at the time of an arc-extinguishing discharge from the arc deflecting plate to the fixed contact plate, and consequently the life of the arc deflecting plate can be prolonged.

It is advisable that the arc deflecting plate 13 in each embodiment is made of ferritic stainless steel plate (SUS 430).

The ordinary arc deflecting plates of iron, are partially evaporated by the heat of the arc and discharged as an arced gas to the exterior. As a result, the arc deflecting iron plates are eroded and become worn and damaged over a long period of use.

In comparison with the arc deflecting plate of ordinary iron the ferritic stainless steel plate formed of SUS 430 is not so different in melting point. However, SUS 430 is so difficult to evaporate as compared with iron that the arc deflecting plates are little worn or damaged by the heat of the arc.

According to the device of this embodiment, therefore, the arc deflecting plates will not undergo wear or damage even over a long period of use, thereby permitting prolongation of the service life thereof.

Since the wear and damage of the arc deflecting plate can be kept to a minimum even against large electric currents, it is possible to largely increase the capacity of the switch.

Although reference was made in the above description only to the case where the present invention was applied to a switch using a magnet for opening and closing the contacts, namely, an electromagnetic contactor, it is apparent that the present invention is applicable also to other switches such as a no-fuse breaker.

According to the present invention, as set forth hereinabove, the metallic arc deflecting plate is provided with a U-shaped portion in a position close to the fixed contact plate. As a result, the breaking performance of the switch can be improved to a remarkable extent.

What is claimed is:

1. A switch comprising:

fixed contact means;

movable contact means adapted for movement to come into contact with said fixed contact means and to go out of contact with the same such that a first gap is defined therebetween; and an arc deflecting plate of magnetic metal provided generally in parallel with said movement, said arc deflecting plate being formed with a U-shaped tongue-like bent portion in proximity to said fixed contact means, said fixed contact means including a fixed contact plate and a fixed contact affixed to said fixed contact plate at an end portion thereof, said fixed contact plate extending in a direction generally perpendicular to said arc deflecting plate to define a second gap therebetween, said U-shaped portion having an outer bottom portion in facing relation to a selected one of said first and second gaps.

2. A switch according to claim 1, wherein said selected gap includes the first gap.

3. A switch according to claim 2, wherein said arc deflecting plate is formed with at least one gas-flow hole in proximity to the U-shaped portion.

4. A switch according to claim 2, wherein said arc deflecting plate includes a channel-shaped plate having a main portion and wing portions extending from respective sides thereof, said channel-shaped plate substantially surrounding the fixed contact means and the movable contact means, said fixed contact plate extending into an opening in said main portion in a direction perpendicular to said main portion, said U-shaped tongue-like portion being provided in said opening in said main portion and having a width substantially the same as the distance between said wing portions.

5. A switch according to claim 2, wherein said U-shaped portion is positioned substantially midway in the first gap between the movable contact means and the fixed contact means when said movable contact means takes an open position.

6. A switch according to claim 4, wherein said arc deflecting plate is formed with at least one gas-hole in proximity to the U-shaped portion.

7. A switch according to claim 2, wherein said U-shaped portion has a tapering free end tongue.

8. A switch according to claim 7, wherein said arc deflecting plate is formed with at least one gas-flow hole in proximity to the U-shaped portion.

9. A switch according to claim 2, wherein said arc deflecting plate includes a channel-shaped plate having a main portion and wing portions extending from respective sides thereof, said channel-shaped plate substantially surrounding the fixed contact means and the movable contact means, said fixed contact plate extending into an opening in said main portion in a direction perpendicular to said main portion, said U-shaped portion being provided in said opening in said main portion and having at least one notch opening in facing relation to the fixed contact.

10. A switch according to claim 9, wherein said notch includes a slit.

11. A switch according to claim 1, wherein said selected gap includes the second gap.

12. A switch according to claim 1, wherein said arc deflecting plate is made of ferritic stainless steel.

* * * * *